US007556538B2

(12) United States Patent
Nakamura

(10) Patent No.: US 7,556,538 B2
(45) Date of Patent: Jul. 7, 2009

(54) CONNECTOR

(75) Inventor: Hideto Nakamura, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 12/109,422

(22) Filed: Apr. 25, 2008

(65) Prior Publication Data

US 2008/0268693 A1 Oct. 30, 2008

(30) Foreign Application Priority Data

Apr. 27, 2007 (JP) ..... 2007-119754

(51) Int. Cl.
*H01R 13/514* (2006.01)

(52) U.S. Cl. ..... 439/752; 439/595

(58) Field of Classification Search ..... 439/752, 439/595, 596, 599

See application file for complete search history.

(56) References Cited

U.S. PATENT DOCUMENTS

| | | | | |
|---|---|---|---|---|
| 4,900,277 | A | 2/1990 | Inaba et al. | |
| 6,280,262 | B1 | 8/2001 | Tanaka | |
| 6,450,840 | B2 * | 9/2002 | Nakamura | 439/752 |
| 6,506,072 | B2 | 1/2003 | Nimura | |
| 6,780,070 | B2 * | 8/2004 | Ishikawa et al. | 439/752 |
| 7,367,837 | B2 * | 5/2008 | Pabst | 439/460 |
| 2002/0168896 | A1 * | 11/2002 | Suzuki | 439/595 |
| 2002/0187676 | A1 * | 12/2002 | Kurimoto et al. | 439/595 |
| 2002/0193011 | A1 * | 12/2002 | Mase et al. | 439/752 |
| 2003/0008557 | A1 * | 1/2003 | Suzuki | 439/595 |
| 2003/0087562 | A1 * | 5/2003 | Okamoto et al. | 439/752 |
| 2003/0096539 | A1 * | 5/2003 | Ichio | 439/752 |
| 2003/0199206 | A1 * | 10/2003 | Mase et al. | 439/752 |
| 2004/0110427 | A1 * | 6/2004 | Shi et al. | 439/752 |
| 2005/0142955 | A1 * | 6/2005 | Horiuchi | 439/752 |
| 2008/0020639 | A1 * | 1/2008 | Ichio | 439/595 |
| 2008/0261425 | A1 * | 10/2008 | Nakamura | 439/188 |
| 2008/0268693 | A1 * | 10/2008 | Nakamura | 439/347 |
| 2009/0035980 | A1 * | 2/2009 | Nakamura | 439/352 |

FOREIGN PATENT DOCUMENTS

| | | |
|---|---|---|
| DE | 100 15 842 C1 | 2/2002 |
| EP | 1 257 010 A2 | 5/2002 |

* cited by examiner

*Primary Examiner*—Ross N Gushi
(74) *Attorney, Agent, or Firm*—Gerald E Hespos; Anthony J. Casella

(57) ABSTRACT

A retainer (30) is formed with a wire holder (43) displaceable between a holding position for holding wires (25) in such a manner as to prevent movements of the wires (25) and a standby position for permitting the movements of the wires (25). A restricting action of a restricting portion (15) prevents the wire holder (43) from being displaced to the holding position unless the retainer (30) is assembled correctly. However, the wire holder (43) can be displaced to the holding position if the retainer (30) is assembled correctly. The assembled state of the retainer (30) can be detected based on whether a displacement of the wire holder (43) to the holding position is possible.

15 Claims, 9 Drawing Sheets

CONNECTOR

BACKGROUND OF THE INVENTION

1. Field of the Invention

The invention relates to a connector.

2. Description of the Related Art

U.S. Pat. No. 6,506,072 discloses a connector with a housing and terminal fittings mounted in the housing. Wires are connected to the terminal fittings and are drawn out from the rear of the housing. A wire holder is provided for strain relief against a tensile force that may be exerted on the wires.

Problems can occur if the connector also has a retainer for retaining terminal fittings in the housing. For example, the terminal fitting may not be inserted sufficiently into the housing, and, as a result, the retainer may not be assembled correctly with the housing. In this situation, a strong pulling force on the wire will cause the terminal fitting to come out of the housing. Thus, the insufficiently inserted state of the terminal fitting and a mounting error of the retainer can be detected. However, the insufficient insertion of the terminal fitting and/or the incomplete insertion of the retainer cannot be detected by pulling the wire if a wire holder is assembled with the housing. More particularly, the wire holder presses the wires to prevent movements of the wires and the terminal fittings. Therefore, the incorrect mounting of the retainer is overlooked in this situation.

The invention was developed in view of the above situation and an object thereof is to detect whether a retainer is assembled correctly.

SUMMARY OF THE INVENTION

The invention relates to a connector with a housing and at least one terminal fitting inserted into the housing. The terminal fitting is fixed to an end of a wire. At least one retainer is assembled with the housing for retaining the terminal fitting. At least one wire holder is provided on the retainer and is displaceable between a holding position and a standby position. The holder is configured and disposed for holding the wire and preventing movements of the wire relative to the housing when the holder is at the holding position. The wire holder is configured for permitting the movements of the wire when the wire holder is at the standby position. At least one restriction is formed on the housing for restricting displacement of the wire holder to the holding position when the retainer is assembled improperly.

The wire holder cannot be displaced to the holding position if the retainer is assembled incorrectly, whereas the wire holder can be displaced to the holding position if the retainer is assembled correctly. Accordingly, the assembled state of the retainer can be detected or verified based on whether or not the wire holder can be displaced to the holding position.

The housing and/or the wire holder are formed with one or more locks for locking the wire holder at the holding position and reliably preventing movements of the wire.

The wire holder and the retainer preferably are formed integrally or unitarily via at least one hinge.

The wire holder preferably projects out more than the retainer when the wire holder is at the standby position with a main portion of the wire holder held at an angle to the retainer.

At least one guide groove preferably is provided on one of the retainer and the housing and is engaged with at least one guide rib on the other of the retainer and the housing upon assembling the retainer to the housing. Additionally, at least one terminal lock of the retainer is fit into at least one guide hole in the housing so that the retainer can be assembled while being prevented from moving in forward and backward directions and/or vertical directions relative to the housing.

The wire preferably is squeezed between one or more receiving projections on one of the retainer and the wire holder and one or more biting projections on the other of the retainer and the wire holder when the wire holder is at the holding position.

The receiving projections and/or the biting projections preferably have points that bite into an insulation coating of the wire. However, the vertical spacing between the receiving projections and the biting projections preferably exceeds an outer diameter of a conductor of the wire.

The retainer preferably is displaceable between a first position where the insertion of the terminal fitting into the housing is permitted and to a second position where the terminal fitting is locked in the housing.

The wire holder preferably is offset from the housing and a lock piece of the wire holder when the retainer is at first position. Thus, even if an attempt is made to displace the wire holder towards the holding position, the right lock piece contacts the restricting portion before the wire holder reaches the holding position to hinder further displacement of the wire holder.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
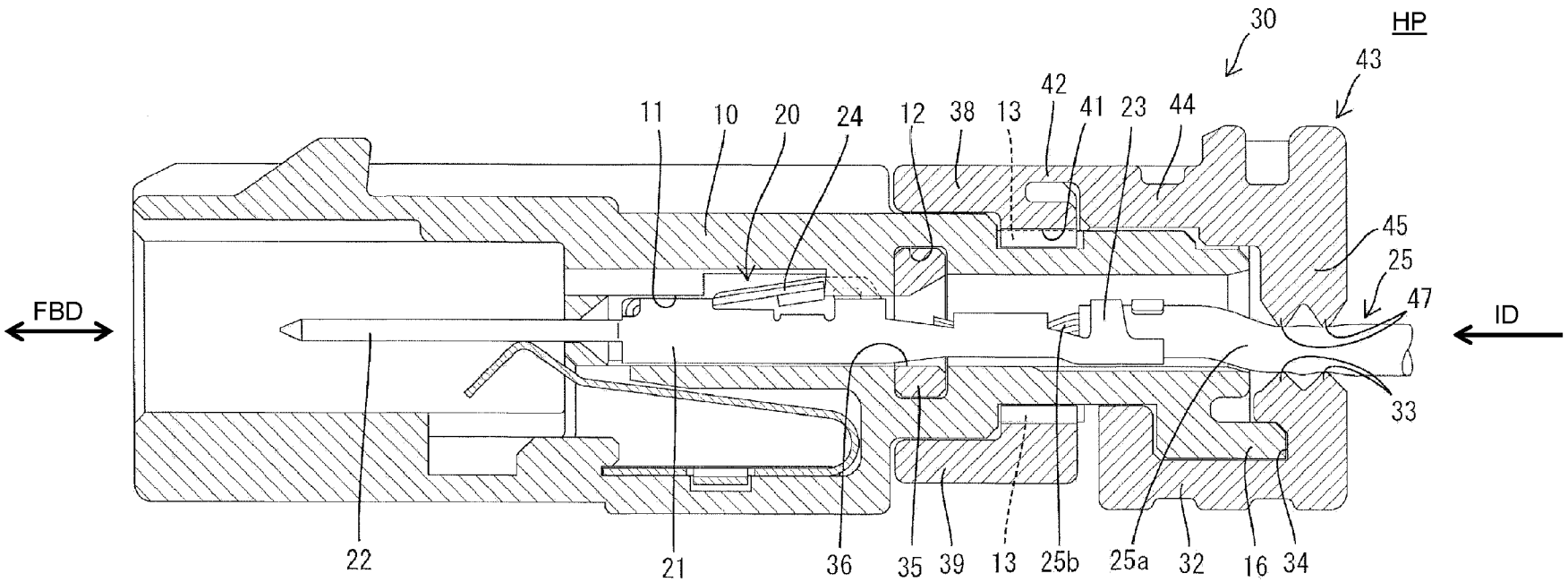
FIG. 1 is a section of one embodiment.
Figure 2:
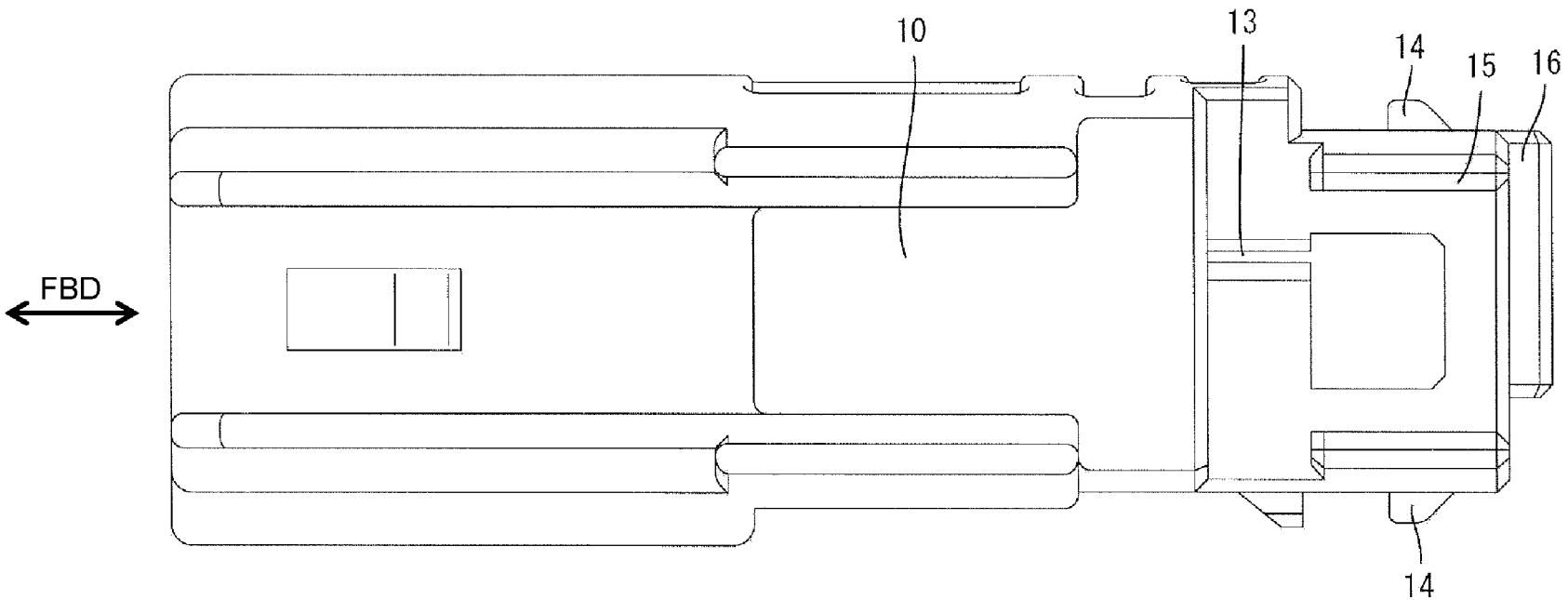
FIG. 2 is a plan view of a housing.
Figure 3:
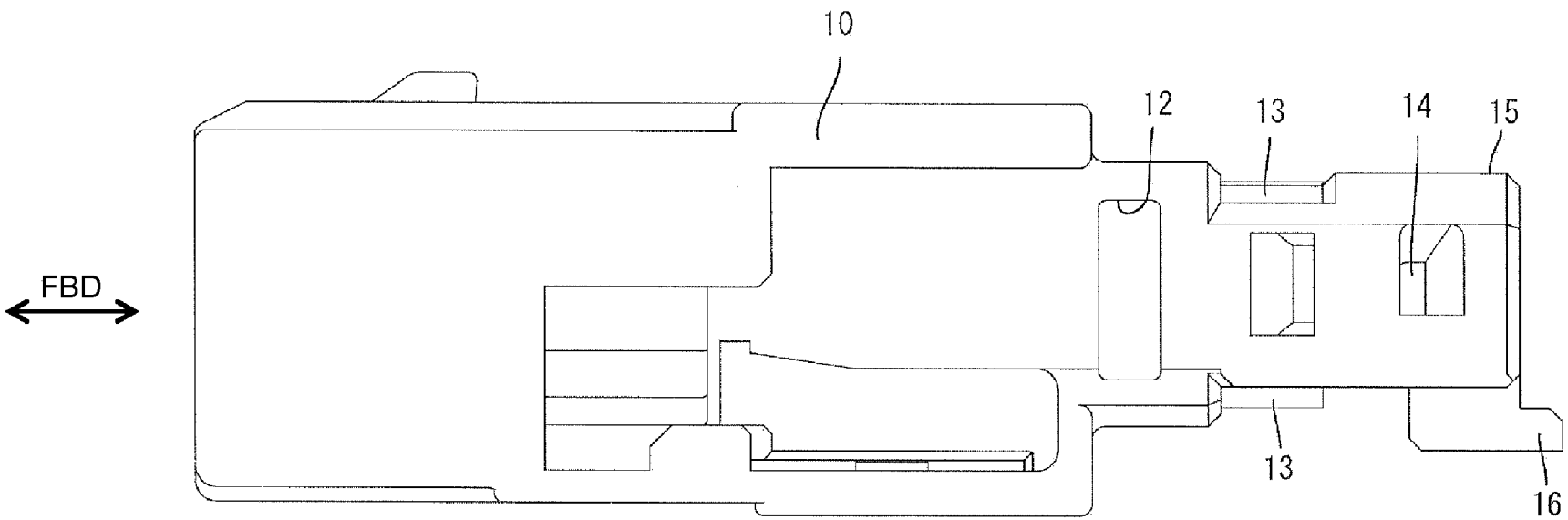
FIG. 3 is a side view of the housing.
Figure 4:
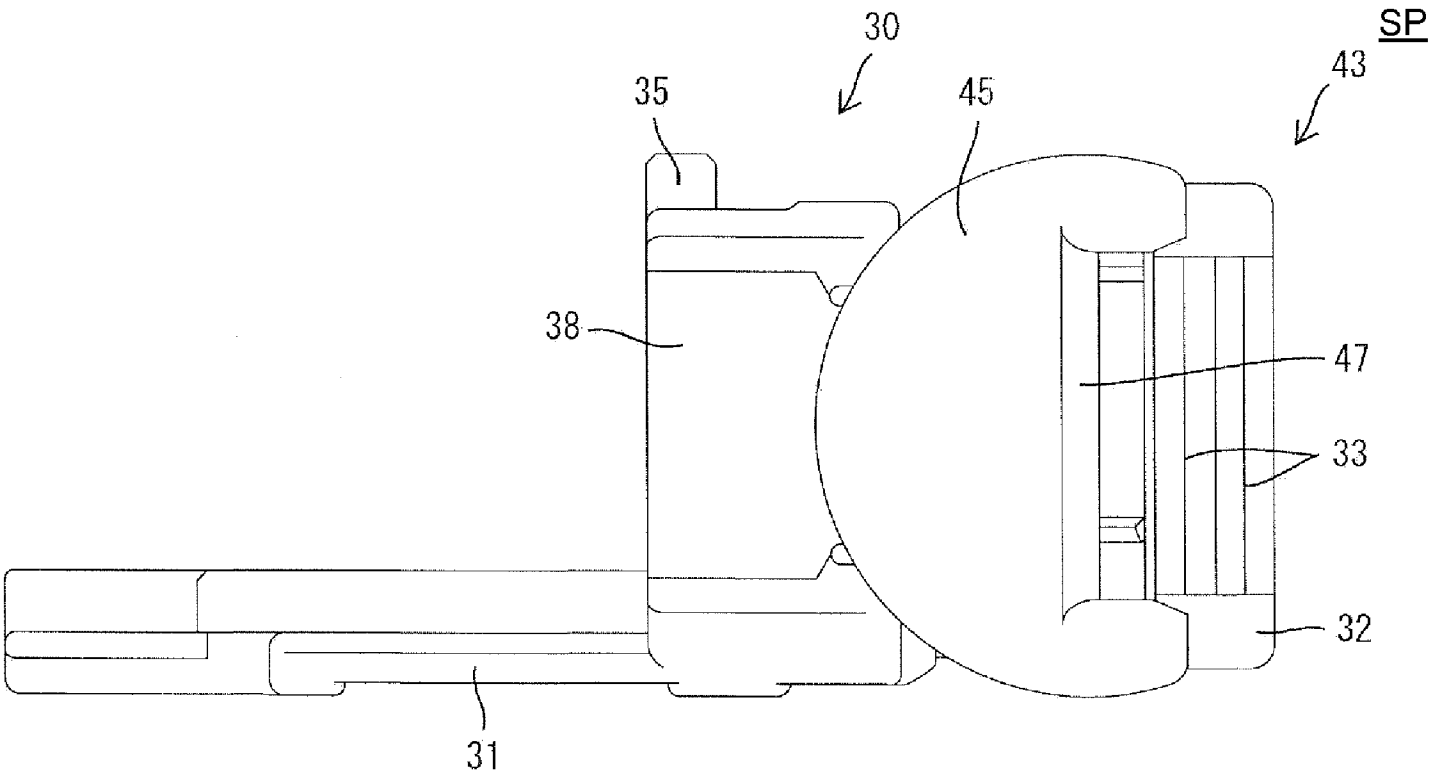
FIG. 4 is a plan view of a retainer.
Figure 5:
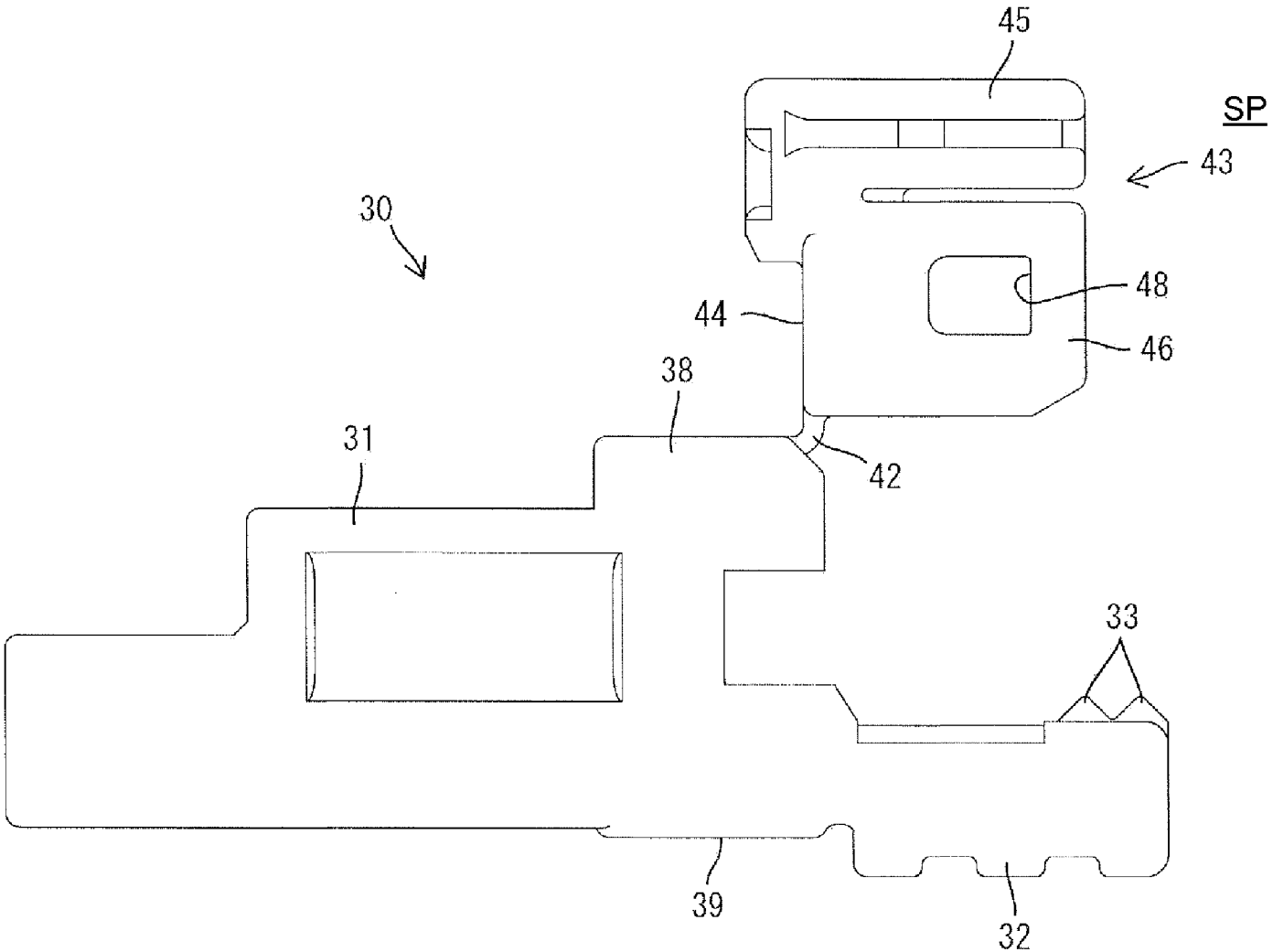
FIG. 5 is a side view of the retainer.
Figure 6:
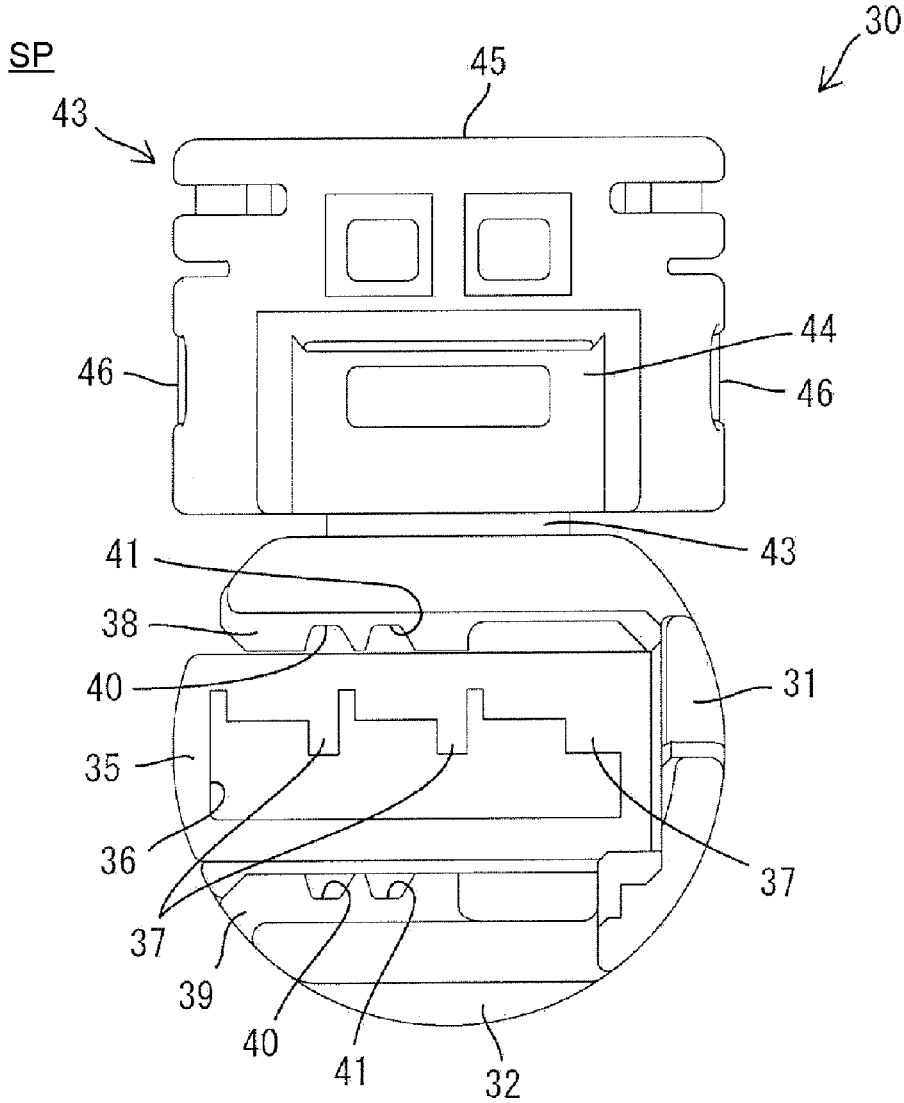
FIG. 6 is a front view of the retainer.
Figure 7:
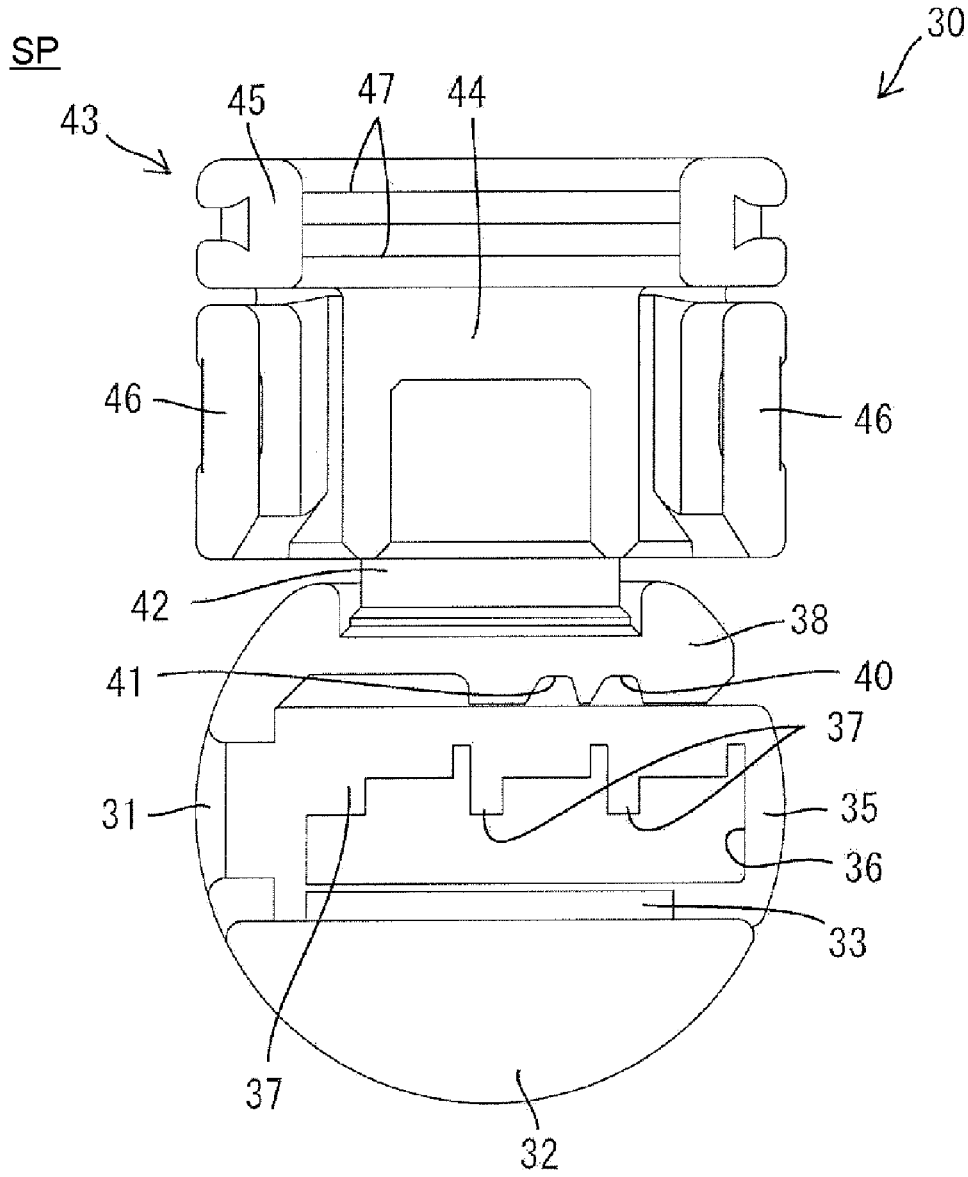
FIG. 7 is a rear view of the retainer.

A connector in accordance with the invention is described with reference to FIGS. 1 to 9. The connector has a housing 10 that is long and narrow in forward and backward directions FBD. Terminal fittings 20 are mounted in the housing 10 and a retainer 30 is assembled with the housing 10.

The housing 10 is made e.g. of synthetic resin, and long narrow cavities 11 extend through the housing in forward and backward directions FBD. The cavities are arranged side by side in the transverse direction of the housing 10. A guide hole 12 opens in the left surface of the housing 10 and communicates with the cavities 11. Two locking ribs 13 extend in forward and backward directions FBD on the top and bottom surfaces of the housing 10 at positions behind the guide hole 12. Two lock projections 14 are formed on the left and right surfaces of the housing 10 at positions behind the locking ribs 13. A restriction 15 is defined at the right upper edge of the rear end of the housing 10. A guide rib 16 extends transversely along the bottom edge of the rear surface of the housing 10.

Each terminal fitting 20 preferably substantially is long and narrow in forward and backward directions FBD and includes a substantially rectangular tube 21. A tab 22 projects forward from the tube 21 and a wire crimping portion 23 in the form of an one open barrel is formed rearward of the tube 21. The wire crimping portion 23 is crimped, bent or folded into connection with the front end of a wire 25 that extends substantially straight and coaxially from the rear end of the terminal fitting 20. The terminal fitting 20 is to be inserted into the cavity 11 from behind and along an insertion direction ID and is retained in the cavity 11 by the engagement of a lock 24 on the tube 21 with a step at an inner surface of the cavity 11. The front end of the guide hole 12 substantially aligns with the rear end of the tube 21 and a front end portion of the wire 25 extends in substantially forward and backward directions FBD in a space at a rear end of the cavity 11 when the terminal fitting 20 is inserted to a proper position while being prevented from moving any further forward.

The retainer 30 is made e.g. of synthetic resin and includes a side wall 31 that covers at least part of the left surface of the housing 10 when the retainer 30 is assembled with the housing 10. The rear end of the side wall 31 is formed with a bottom wall 32 that extends substantially backward. Front and rear receiving ribs 33 extend substantially transversely along the rear end edge of the upper surface of the bottom wall 32. The receiving ribs 33 project up or in and have a triangular or pointed cross section. A guide groove 34 extends transversely in the bottom wall 32 and opens in the upper surface and right surface. A substantially plate-like terminal lock 35 extends laterally near the rear end of the side wall 31 and a through hole 36 penetrates the terminal lock 35 in substantially forward and backward directions FBD. The through hole 36 defines one large space corresponding to the three cavities 11, and three retaining portions 37 corresponding to the respective cavities 11 are formed at the upper part of the opening edge of the through hole 36. An upper arm 38 is cantilevered laterally at an upper part of the rear edge of the side wall 31 and a lower arm 39 is cantilevered laterally from a lower part of the bottom edge of the side wall 31. The lower surface of the upper arm 38 is formed with a partial locking groove 40 and a full locking groove 41 is located laterally of the partial locking groove 40. Similarly, the upper surface of the lower arm portion 39 also is formed with a partial locking groove 40 and a full locking groove 41 is located laterally of the partial locking groove 40.

A substantially flat flexible hinge 42 extends unitarily along the rear end edge of the upper arm 38, and a wire holder 43 is formed unitarily at a side of the hinge 42 opposite the upper arm 38. A substantially flat main portion 44 is defined at the front edge of the wire holder 43 and is continuous with the hinge 42. A substantially semicircular pressing portion 45 extends from the rear edge of the flat main portion 44 at a side substantially opposite the hinge 42 and is aligned substantially normal to the flat main portion 44. Two substantially rectangular plate-shaped lock pieces 46 extend in the same direction as the pressing portion 45 from the opposite left and right edges of the flat main portion 44. Two biting ribs 47 extend from an extending end of the pressing portion 45 and, similar to the receiving projections 33, are aligned substantially normal to the inserting direction ID. The biting ribs 47 have triangular or pointed cross sections. The respective lock pieces 46 are formed with lock holes 48.

The wire holder 43 is at an inoperative standby position SP (see FIGS. 4 to 7) before being assembled with the housing 10, and projects more out and up than the upper arm 38. The flat main portion 44 is substantially at right angles to the upper arm 38 when the wire holder 43 is in the standby position SP and the lock pieces 46 extend back from the flat main portion 44. The retainer 30 is assembled with the housing 10 from the left. As a result, the guide groove 34 engages the guide rib 16. Additionally, the terminal lock 35 fits into the guide hole 12 and the side wall 31 is placed on the left surface of the housing 10. Thus, the retainer 30 is assembled and is prevented from moving in forward and backward directions FBD or the vertical direction relative to the housing 10. In the assembling process, the upper and lower arms 38, 39 contact the locking projections 13 and resiliently displace to widen the vertical spacing therebetween. The two arms 38, 39 resiliently restore when the retainer 30 reaches the partial locking position so that the partial locking grooves 40 engage the locking projections 13 for locking. Thus, the retainer 30 is held at the partial locking position 1P by this locking action.

Figure 8:
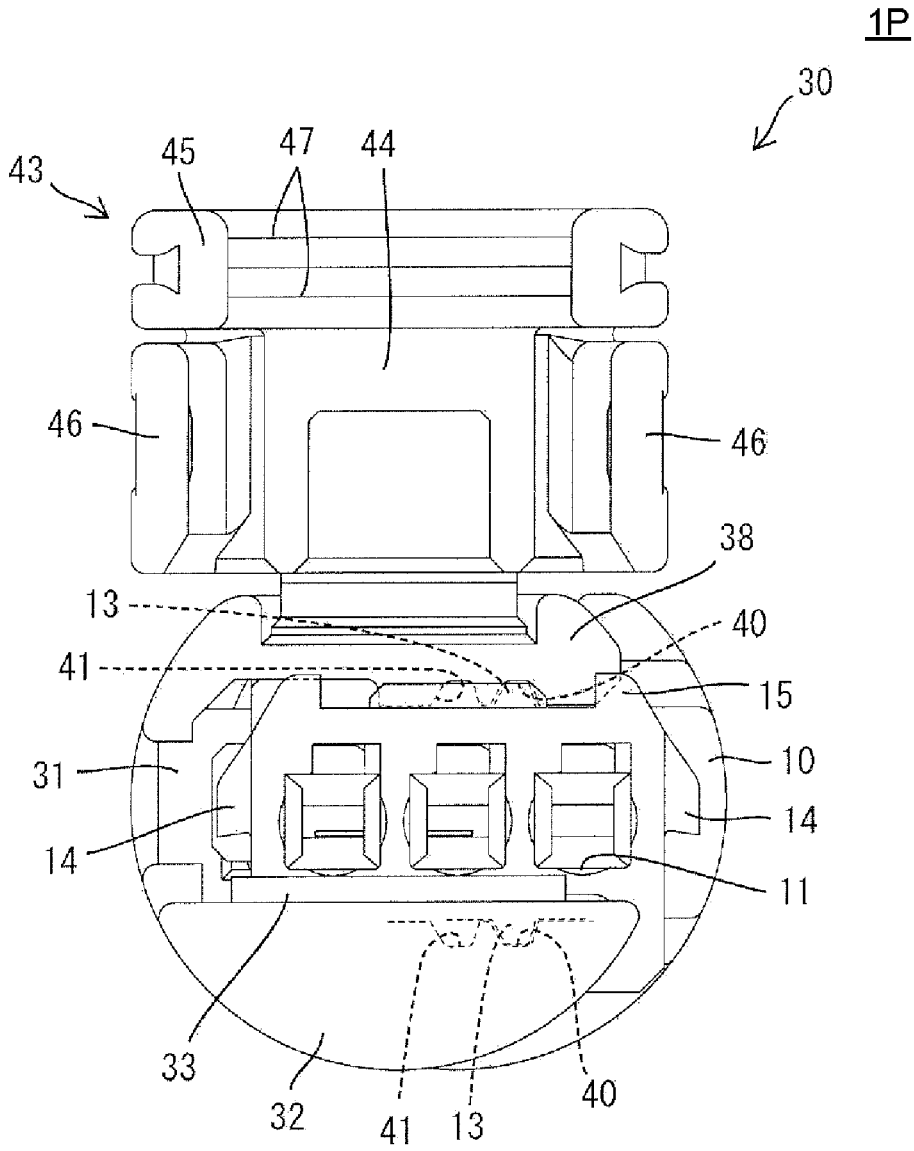
FIG. 8 is a rear view showing the retainer at a partial locking position.
Figure 9:
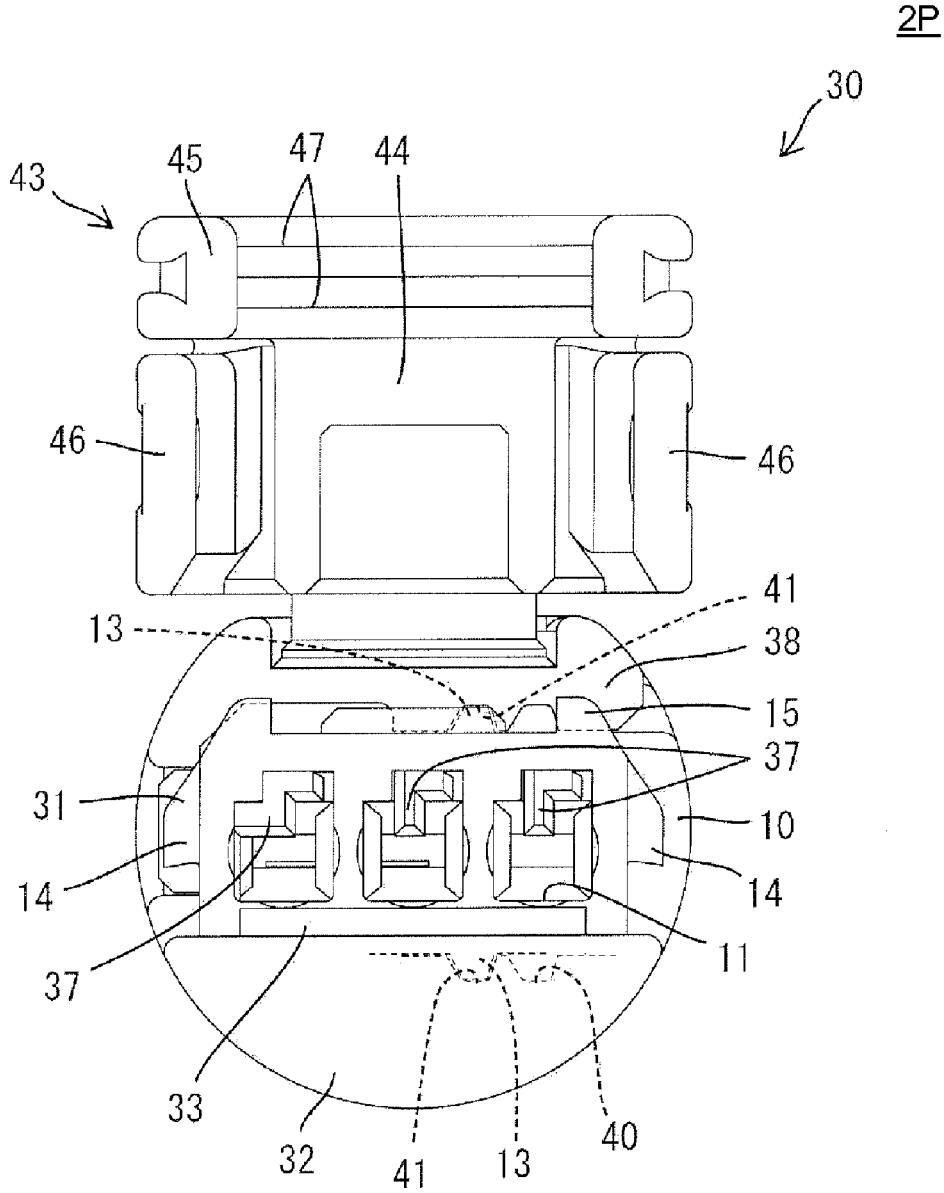
FIG. 9 is a rear view showing the retainer at a full locking position.

The wire holder 43 is offset from the housing 10 when the retainer 30 is at the partial locking position 1P and the right lock piece 46 is aligned transversely with the restriction 15 of the housing 10, as shown in FIG. 8. An attempt could be made to pivot the wire holder 43 down about the hinge 42 while the retainer 30 is at the partial locking position 1P of FIG. 8. However, the right lock piece 46 will contact the upper end of the restriction 15 before the wire holder 43 reaches a holding position HP to hinder further downward rotation of the wire holder 43. The terminal lock 35 penetrates the cavities 11. However, the retaining portions 37 in the through hole 36 are retracted laterally of the insertion paths for the terminal fittings 20 in the cavities 11. Thus, the retainer 30 does not hinder insertion of the terminal fittings 20 into the cavities 11.

The terminal fittings 20 are inserted into the respective cavities 11 and are retained by the locks 24 while the retainer 30 is at the partial locking position 1P and while the wire holder 43 is at the standby position SP. The lock 24 is formed by cutting and bending a part of the rectangular tube 21 and has a relatively low strength. Thus, there is a likelihood that the lock 24 will break and the terminal fitting 20 will come out from the cavity 11 if the wire 25 is pulled hard backward in this state. Accordingly, the retainer 30 is pushed from the partial locking position 1P to the full locking position 2P after all three terminal fittings 20 are inserted. At this time, the upper and lower arms 38, 39 interfere with the locking ribs 13 and displace to widen the spacing therebetween. The arms 38, 39 restore resiliently and the locking ribs 13 engage the full locking grooves 41 to lock the retainer 30 at the full locking position 2P.

The retaining portions 37 engaged the rectangular tubes 21 from behind when the retainer 30 is at the full locking position 2P for reliably locking and retaining the terminal fittings 20. The retaining portion 37 will contact the lateral surface of the rectangular tube 21 of any terminal fitting 20 that is not inserted sufficiently and will prevent the retainer 30 from reaching the full locking position 2P. Therefore, the presence of an insufficiently inserted terminal fitting 20 can be detected by the inability to move the retainer 30 from the partial locking position 1P to the full locking position 2P.

The right lock piece 46 is displaced laterally from the restriction 15 in the transverse direction when the retainer 30 is at the full locking position 2P and substantially faces the right lock projection 14. The opposite left lock piece 46 also substantially faces the opposite left lock projection 14. The lock pieces 46 will interfere with the lock projections 14 if the wire holder 43 and hence the lock pieces 46 will displace to widen the transverse spacing therebetween. The lock pieces 46 restore resiliently when the wire holder 43 reaches the holding position HP so that the lock holes 48 engage the lock projections 14 to lock the wire holder 43 at the holding position HP.

The three wires 25 are squeezed between the receiving ribs 33 of the retainer 30 and the biting ribs 47 of the wire holder 43 with the wire holder 43 locked at the holding position HP. The receiving ribs 33 and the biting ribs 47 preferably have triangular or pointed cross sections and bite in the insulation coatings 25*a* of the wires 25. However, the vertical spacing between the receiving ribs 33 and the biting ribs 47 exceeds the outer diameter of the conductors 25*b* of the wires 25. Thus, there is no likelihood of the receiving ribs 33 and the biting ribs 47 damaging the conductors 25*b*. The squeezed wires 25 are prevented from moving in forward and backward directions FBD relative to the housing 10. This strain relief action ensures that a rearward tensile force on the wire 25 at a position behind the wire holder 43 is not transmitted to the wire crimping portion 23 in the cavity 11. Therefore, the connected state of the wire crimping portion 23 with the wire 25 can be stable and substantially no load may act on the lock 24.

The retainer 30 might be left at the partial locking position 1P when an attempt is made to connect the connector with a mating connector (not shown). However, the side wall 31 projects from the lateral surface of the housing 10 and, hence, interferes with the front end of a tubular fitting of the mating connector. Accordingly, the assembled state of the retainer 30 can be verified based on the presence or absence of such interference. The wire holder 43 projects up prior to being pivoted to the holding position HP and will interfere with the entrance of the layout passage for the wiring harness. Therefore the position of the wire holder 43 can be detected or verified based on the presence or absence of such interference.

The wire holder 43 is unitary with the retainer 30, and is displaceable between the holding position HP for preventing movement of the wires 25 relative to the housing 10 and the standby position SP for permitting movement of the wires 25. The housing 10 is formed with the restriction 15 for restricting displacement of the wire holder 43 to the holding position HP when the retainer 30 is assembled improperly (i.e. at the partial locking position 1P rather than the full locking position 2P). Thus, the wire holder 43 cannot be displaced to the holding position HP unless the retainer 30 is assembled correctly at the full locking position 2P, whereas the wire holder 43 can be displaced to the holding position HP if the retainer 30 is assembled at the full locking position 2P. Therefore, the assembled state of the retainer 30 can be detected or verified based on whether the wire holder 43 can be displaced to the holding position. Furthermore, efficiency is improved due to the avoidance of handling errors.

The housing 10 and the wire holder 43 are formed with lock projections 14 and lock holes 48 for engaging one another and locking the wire holder 43 at the holding position HP. The engagement of the locks 14/48 keeps the wire holder 43 at the holding position HP for reliably preventing movements of the wires 25.

The invention is not limited to the above described and illustrated embodiment. For example, the following embodiments are also embraced by the technical scope of the present invention as defined by the claims.

The lock for locking the wire holder at the holding position may be formed in the retainer instead of being formed on the housing.

The retainer and the wire holder may be separate mounting parts instead of being integrally connected via the hinge into a single part.

The retainer may not be held at the partial locking position with respect to the housing.

The terminal fittings may be female terminal fittings having no tabs at their front ends.

The wires may be squeezed between the wire holder and the housing instead of being squeezed between the wire holder and the retainer.

What is claimed is:

1. A connector, comprising:

a housing;

at least one terminal fitting fixed to an end of a wire and configured for insertion into the housing;

a retainer assembled with the housing and configured for retaining the terminal fitting in the housing;

a wire holder on the retainer and being displaceable between a holding position and a standby position, the wire holder being configured for holding the wire and preventing movements of the wire relative to the housing when the wire holder is at the holding position, the wire holder being configured for permitting movement of the wire when the wire holder is at the standby position; and at least one restriction formed on the housing at a position for restricting a displacement of the wire holder to the holding position when the retainer is assembled improperly.

2. The connector of claim 1, wherein at least one of the housing and the wire holder are formed with at least one lock for locking the wire holder at the holding position.

3. The connector of claim 1, wherein the wire holder and the retainer are formed unitarily via at least one hinge.

4. The connector of claim 1, wherein the wire holder projects more outward than the retainer when the wire holder is at the standby position.

5. The connector of claim 1, wherein the housing has at least one guide rib extending transverse to an inserting direction of the terminal fitting into the housing, the retainer having at least one guide groove that engages the guide rib for preventing movement of the retainer in directions transverse to the inserting direction of the terminal fitting into the housing and transverse to the guide rib.

6. The connector of claim 5, wherein the housing has a guide hole extending transverse to the inserting direction of the terminal fitting into the housing, the retainer having a terminal lock fit into the guide hole in the housing for preventing the retainer from moving along the inserting direction of the terminal fitting into the housing.

7. The connector of claim 1, further comprising at least one receiving rib on one of the retainer and the wire holder and at least one biting rib on the other of the retainer and the wire holding portion, the receiving rib and the biting rib being dimensioned for squeezing the wire when the wire holder is at the holding position.

8. The connector of claim 7, wherein at least one of the receiving rib and the biting rib defines a point configured for engaging an insulation coating of the wire, a spacing between the receiving rib and the biting rib exceeding an outer diameter of a conductor of the wire.

9. The connector of claim 1, wherein the retainer is displaceable between a first position where insertion of the terminal fitting into the housing is permitted and a second position where the terminal fitting is locked in the housing.

10. The connector of claim 9, wherein the wire holder has a lock that contacts the restriction and prevents displacement of the wire holder to the holding position when the retainer is at the first position.

11. A connector, comprising:

a housing having cavities extending along forward and backward directions, a guide hole transverse to the forward and backward directions and intersecting the cavity;

terminal fittings fixed to ends of wires and inserted respectively in the cavities;

a retainer disposed in the guide hole and displaceable between a first position where insertion of the terminal fitting into the cavity is permitted and a second position where the retainer locks the terminal fitting in the cavity;

a wire holder on the retainer and being displaceable between a standby position where the wire holder permits movement of the wire and a holding position where the wire holder holds the wire fixedly relative to the housing; and a restriction formed on the housing at a position for restricting a displacement of the wire holder to the holding position when the retainer is at the first position.

12. The connector of claim 11, wherein the wire holder is joined unitarily to the retainer by hinge, the hinge being oriented so that the wire holder is pivotable about a hinge axis aligned transverse to the forward and backward directions.

13. The connector of claim 12, wherein the wire holder projects more outward than the retainer when the wire holder is at the standby position.

14. The connector of claim 11, wherein the housing and the wire holder are formed with locks engageable with one another and configured for locking the wire holder at the holding position.

15. The connector of claim 11, wherein the retainer and the wire holder have pointed ribs dimensioned for biting into the wires.

* * * * *